US009111491B2

(12) United States Patent
Woo et al.

(10) Patent No.: US 9,111,491 B2
(45) Date of Patent: Aug. 18, 2015

(54) ORGANIC LIGHT EMITTING DISPLAY DEVICE AND METHOD FOR DRIVING THE SAME

(71) Applicant: LG Display Co., Ltd., Seoul (KR)

(72) Inventors: Kyoung Don Woo, Gyeonggi-do (KR); Nari Kim, Gyeonggi-do (KR); Jae Hoon Jung, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 53 days.

(21) Appl. No.: 14/134,173

(22) Filed: Dec. 19, 2013

(65) Prior Publication Data

US 2014/0176525 A1 Jun. 26, 2014

(30) Foreign Application Priority Data

Dec. 21, 2012 (KR) ..... 10-2012-0151218

(51) Int. Cl.
*G09G 3/32* (2006.01)

(52) U.S. Cl.
CPC ..... *G09G 3/3275* (2013.01); *G09G 3/3233* (2013.01); *G09G 3/3291* (2013.01); *G09G 2300/0819* (2013.01); *G09G 2310/0248* (2013.01); *G09G 2310/0262* (2013.01); *G09G 2320/0295* (2013.01); *G09G 2320/043* (2013.01)

(58) Field of Classification Search
CPC ..... G09G 2300/0842; G09G 2320/0295; G09G 2320/043; G09G 2320/045; G09G 3/3208; G09G 3/3233; G09G 3/3291; H03K 17/30; H03M 1/1023; H03M 1/123; H03M 1/1295; H03M 1/56
See application file for complete search history.

(56) References Cited

U.S. PATENT DOCUMENTS

| | | | | |
|---|---|---|---|---|
| 2005/0029453 | A1 * | 2/2005 | Allen et al. | 250/332 |
| 2010/0073335 | A1 | 3/2010 | Min et al. | |
| 2011/0007067 | A1 * | 1/2011 | Ryu et al. | 345/214 |
| 2013/0162617 | A1 * | 6/2013 | Yoon et al. | 345/211 |

FOREIGN PATENT DOCUMENTS

| | | | |
|---|---|---|---|
| JP | 2010079255 | A | 4/2010 |
| JP | 2010-185953 | A | 8/2010 |

* cited by examiner

*Primary Examiner* — Gerald Johnson
(74) *Attorney, Agent, or Firm* — Morgan, Lewis & Bockius LLP

(57) ABSTRACT

An organic light emitting display device includes a display panel including a plurality of pixels having an organic light emitting diode and a pixel circuit; a gate driver to supply the plurality of pixels with a scan signal, a sensing signal, and a driving voltage; a data driver to supply data voltages and a reference voltage to the plurality of pixels in a driving mode, and sense voltages charged into the plurality of pixels in a sensing mode; a discharging driving unit to initialize voltages of a plurality of sensing power lines when the display device switches from the driving mode to the sensing mode; a timing controller to control the gate driver, the data driver, and the discharging driving unit to operate in and switch between the driving mode and the sensing mode; and a memory to store compensation data for the plurality of pixels.

13 Claims, 6 Drawing Sheets

ORGANIC LIGHT EMITTING DISPLAY DEVICE AND METHOD FOR DRIVING THE SAME

CROSS-REFERENCE TO RELATED APPLICATIONS

This application claims the benefit of priority of Korean Patent Application No. 10-2012-0151218 filed on Dec. 21, 2012, which is hereby incorporated by reference as if fully set forth herein.

BACKGROUND

1. Field of the Disclosure

The present embodiments relate to an organic light emitting display device, and more particularly, to an organic light emitting display device and a method of driving the same, that prevent a sensing defect and increase an accuracy of external compensation, thus enhancing a display quality.

2. Discussion of Related Art

General organic light emitting display devices may include a display panel, which includes a plurality of pixels respectively formed in a plurality of pixel areas defined by intersections between a plurality of data lines and a plurality of gate lines, and a panel driver that causes light to emit from the plurality of pixels.

FIG. 1 is a circuit diagram for describing a pixel structure of a related art organic light emitting display device. With reference to FIG. 1, each pixel of the display panel may include a first switching TFT ST1, a second switching TFT ST2, a driving TFT DT, a capacitor Cst, and an organic light emitting diode OLED.

The first switching TFT ST1 may be turned on according to a scan signal (gate driving signal) supplied to a corresponding gate line GL. As the first switching TFT ST1 is turned on, a data voltage Vdata supplied to a corresponding data line DL may be supplied to the driving TFT DT.

The driving TFT DT may be turned on according to the data voltage Vdata supplied to the first switching TFT ST1. A data current I_oled flowing to the organic light emitting diode OLED may be controlled by a switching time of the driving TFT DT.

The capacitor Cst may be connected between a gate and source of the driving TFT DT. The capacitor Cst may store a voltage corresponding to the data voltage Vdata supplied to the gate of the driving TFT DT. The driving TFT DT may be turned on with the voltage stored in the capacitor Cst.

The organic light emitting diode OLED may be electrically connected between the source of the driving TFT DT and a cathode voltage VSS. The organic light emitting diode OLED may emit light according to the data current I_oled supplied from the driving TFT DT.

The related art organic light emitting display device may control a level of the data current I_oled flowing from a first driving voltage VDD terminal to the organic light emitting diode OLED by a switching time of the driving TFT DT based on the data voltage Vdata. Therefore, the organic light emitting diode OLED of each pixel emits light to thereby realize an image.

However, the threshold voltage (Vth) and mobility characteristics of the driving TFTs DT of the respective pixels may be different due to non-uniformity of the TFT manufacturing process. For this reason, in general organic light emitting display devices, despite that the same data voltage Vdata is applied to the driving TFTs DT of the respective pixels, a deviation of currents flowing in the respective organic light emitting diodes OLED occurs, causing the display device to have non-uniform image quality.

To solve the non-uniform image quality, a plurality of the sensing signal lines SL may be formed in the same direction as that of the gate lines GL, and a second switching TFT ST2 may be additionally formed in each pixel. The second switching TFT ST2 may be turned on according to a sensing signal applied to a corresponding sensing signal line SL. When the second switching TFT ST2 is turned on, the data current I_oled supplied to the organic light emitting diode OLED may be supplied to an analog-to-digital converter (ADC) of a data driver.

FIG. 2 is a diagram for describing a display and sensing driving method of a related art organic light emitting display device.

With reference to FIG. 2, in a driving mode where an image is displayed, data voltages Vdata corresponding to image data may be respectively supplied from the first data line to the last data line during a period of an Nth frame, thereby enabling an image to be displayed.

In a sensing mode, the display device may supply a sensing signal to one or some of all the sensing signal lines to perform real-time sensing during a blank interval between an nth frame and an n+1st frame. In a driving period where an image is displayed, a driving voltage Vref may be set as a display reference voltage Vpre_r. In a sensing period, the driving voltage Vref may be set as a sensing reference voltage Vpre_s.

The display device may supply a precharging voltage Vpre_s to all the pixels or some pixels to be sensed, and may selectively turn on the second switching TFTs ST2 of all the pixels or some pixels to detect a voltage charged into each of the corresponding sensing power lines RL. Subsequently, the display device may convert the detected voltage into compensation data corresponding to a threshold voltage/mobility of the driving TFT DT of a corresponding pixel P.

In such a scheme, the display device may detect the threshold voltage/mobility of the driving TFT DT of each pixel of the display panel during a blank interval of a plurality of frames. The display device may generate compensation data on the basis of the detected threshold voltage/mobility, and compensate for a data voltage Vdata applied to each pixel by using the compensation data.

Voltages of the reference power lines RL can respectively increase according to data voltages supplied in the driving mode. For example, a voltage of each of the reference power lines RL can increase by 0.5 V according to a white data voltage and a black data voltage.

In switching from the driving mode to the sensing mode, because a data voltage supplied in the driving period may not be sufficiently discharged, a voltage deviation of several tens of mV may occur between a plurality of sensing initial voltages. When a deviation of the sensing initial voltages occurs, a voltage deviation of several tens of mV may thereby occur between a plurality of sensing voltages, and for this reason, the accuracy of sensing for the external compensation is reduced.

FIG. 3 is a diagram for describing a problem in the related art of a non-uniform image quality caused by a sensing error.

With reference to FIG. 3, in switching from the driving mode to the sensing mode, sensing errors due to insufficient discharging can be continuously accumulated. In a state where the sensing errors are accumulated, when compensation of each pixel is performed, non-uniformity of the image quality can occur, causing a degradation of display quality. That is, in the driving mode, a deviation of sensing voltages may occur due to a pattern of an image displayed by the pixels, thereby causing a sensing error.

To solve such a problem, in switching from the driving mode to the sensing mode, the display device may wait until 100% discharge, and then sense each pixel. However, it can typically take several tens of milliseconds (for example, 30 ms to 50 ms) for discharging to be completed. This increase in discharging time causes the additional problem that the time available for sensing is shortened.

SUMMARY

Accordingly, the present embodiments are directed to providing an organic light emitting display device and a method of driving the same that substantially obviate one or more problems due to limitations and disadvantages of related art.

An aspect of the present embodiments is directed to providing an organic light emitting display device and a method of driving the same, that may enable complete discharging to be performed within an early time when switching from a driving mode to a sensing mode.

Another aspect of the present embodiments is directed to providing an organic light emitting display device and a method of driving the same, that can sense pixels independently from a pattern of an image displayed by the pixels, in a driving mode.

Another aspect of the present embodiments is directed to providing an organic light emitting display device and a method of driving the same, that can prevent a non-uniformity of an image quality due to a sensing error when switching from a driving mode to a sensing mode.

Another aspect of the present embodiments is directed to providing an organic light emitting display device and a method of driving the same, which can save time taken in discharging data voltages when switching from a driving mode to a sensing mode.

Additional advantages and features of the present will be set forth in part in the description which follows and in part will become apparent to those having ordinary skill in the art upon examination of the following or may be learned from practice of the present embodiments. The objectives and other advantages of the present embodiments may be realized and attained by the structure particularly pointed out in the written description and claims hereof as well as the appended drawings.

To achieve these and other advantages and in accordance with the purpose of the present embodiments, as embodied and broadly described herein, there is provided an organic light emitting display device including: a display panel configured to include a plurality of pixels that include an organic light emitting diode and a pixel circuit emitting light from the organic light emitting diode; a gate driver configured to supply a scan signal used for driving the plurality of pixels, a sensing signal for sensing, and a driving voltage; a data driver configured to supply respective data voltages and a reference voltage to the plurality of pixels in a driving mode, and sense respective voltages charged into the plurality of pixels in a sensing mode; a discharging driving unit configured to initialize voltages of a plurality of sensing power lines corresponding to the plurality of pixels in switching the driving mode to the sensing mode; a timing controller configured to control the gate driver, the data driver, and the discharging driving unit to operate in a display mode and the sensing mode; and a memory configured to store compensation data for compensating for the plurality of pixels.

In another aspect of the present invention, there is provided a method of driving an organic light emitting display device, including a plurality of pixels that include an organic light emitting diode and a pixel circuit emitting light from the organic light emitting diode, including: respectively supplying data voltages corresponding to image data to a first data line to a last data line during a period of one frame to display an image, in a driving mode where an image is displayed; connecting a plurality of sensing power lines, corresponding to the plurality of pixels, to a ground to initialize voltages of the sensing power lines, in switching the driving mode to a sensing mode; after the sensing power lines are initialized, supplying a sensing precharging voltage to the sensing power lines; floating the sensing power lines, and sensing the voltages of the sensing power lines; generating compensation data corresponding to a threshold voltage and mobility of a driving thin film transistor of each of the plurality of pixels on the basis of the sensed voltages; and compensating for the plurality of pixels on the basis of the compensation data.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the embodiments and are incorporated in and constitute a part of this application, illustrate example embodiments and together with the description serve to explain the principle of the invention. In the drawings.

DETAILED DESCRIPTION OF THE INVENTION

Figure 1:
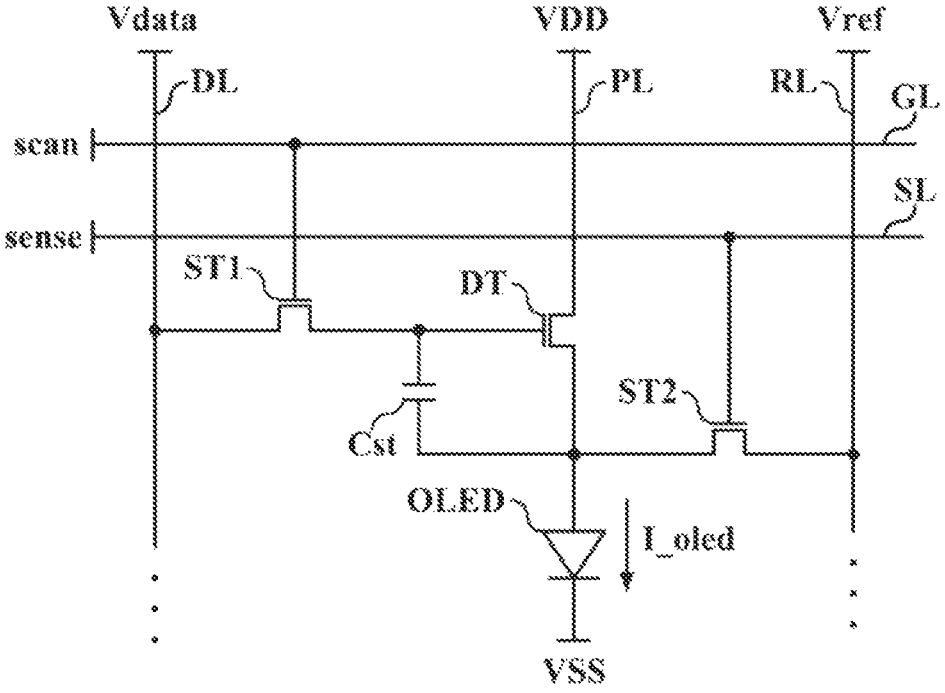
FIG. 1 Related Art
FIG. 1 is a circuit diagram illustrating a pixel structure of a related art organic light emitting display device.
Figure 2:
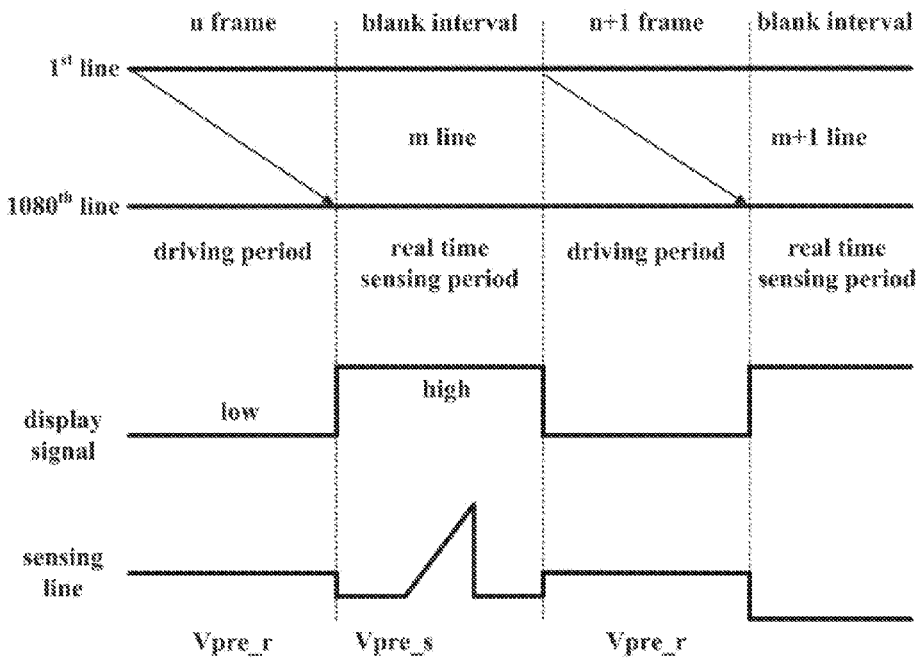
FIG. 2 Related Art
FIG. 2 is a diagram illustrating a display and sensing driving method of a related art organic light emitting display device.
Figure 3:
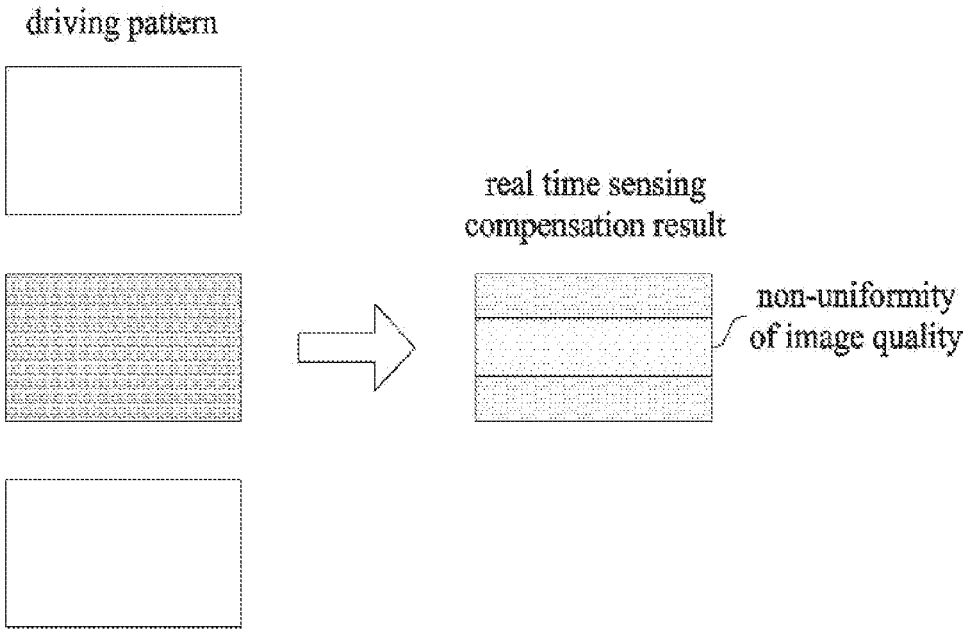
FIG. 3 Related Art
FIG. 3 is a diagram illustrating a problem related to non-uniformity of image quality caused by a sensing error in the related art.

In the specification, in adding reference numerals for elements in each drawing, like reference numerals may be used for like elements.

The terms described in the specification should be understood as follows.

As used herein, the singular forms “a”, “an” and “the” are intended to include the plural forms as well, unless the context clearly indicates otherwise. The terms “first” and “second” are for differentiating one element from the other element, and these elements should not be limited by these terms.

It will be further understood that the terms “comprises”, “comprising,”, “has”, “having”, “includes” and/or “including”, when used herein, specify the presence of stated features, integers, steps, operations, elements, and/or components, but do not preclude the presence or addition of one or more other features, integers, steps, operations, elements, components, and/or groups thereof.

The term “at least one” should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Hereinafter, embodiments of an organic light emitting display device and a method of driving the same will be described in detail with reference to the accompanying drawings.

A compensation scheme may be categorized into an internal compensation scheme and an external compensation scheme, depending on a position of a circuit that compensates for a characteristic deviation of pixels. The internal compensation scheme may be a scheme in which a compensation circuit for compensating for a characteristic deviation of pixels is disposed inside each of the pixels. The external compensation scheme may be a scheme in which the compensation circuit for compensating for a characteristic deviation of pixels is disposed outside each pixel. The present embodiments may relate to an organic light emitting display device using the external compensation scheme and a method of driving the same.

Figure 4:
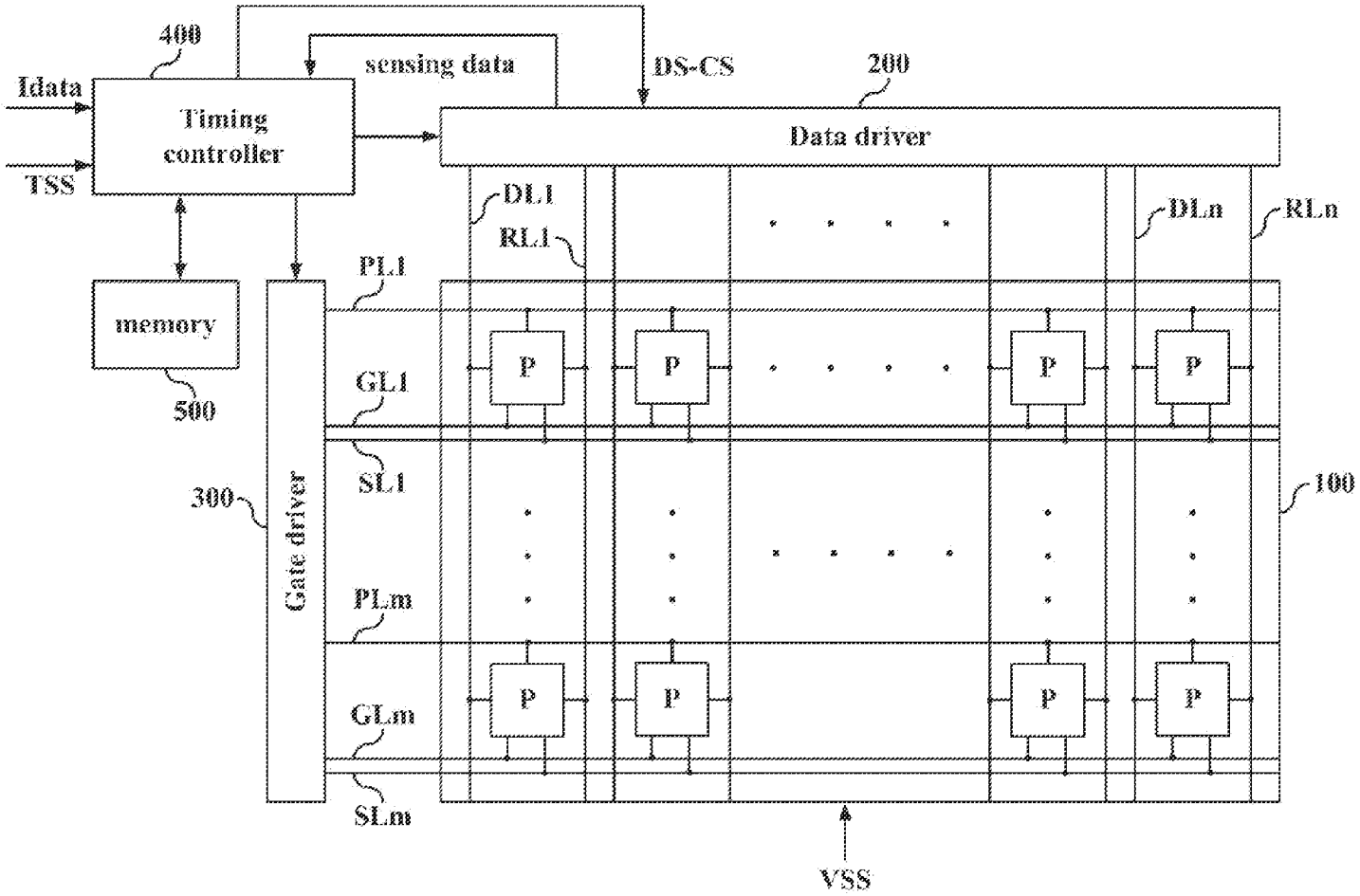
FIG. 4 is a diagram schematically illustrating an organic light emitting display device according to an embodiment.
Figure 5:
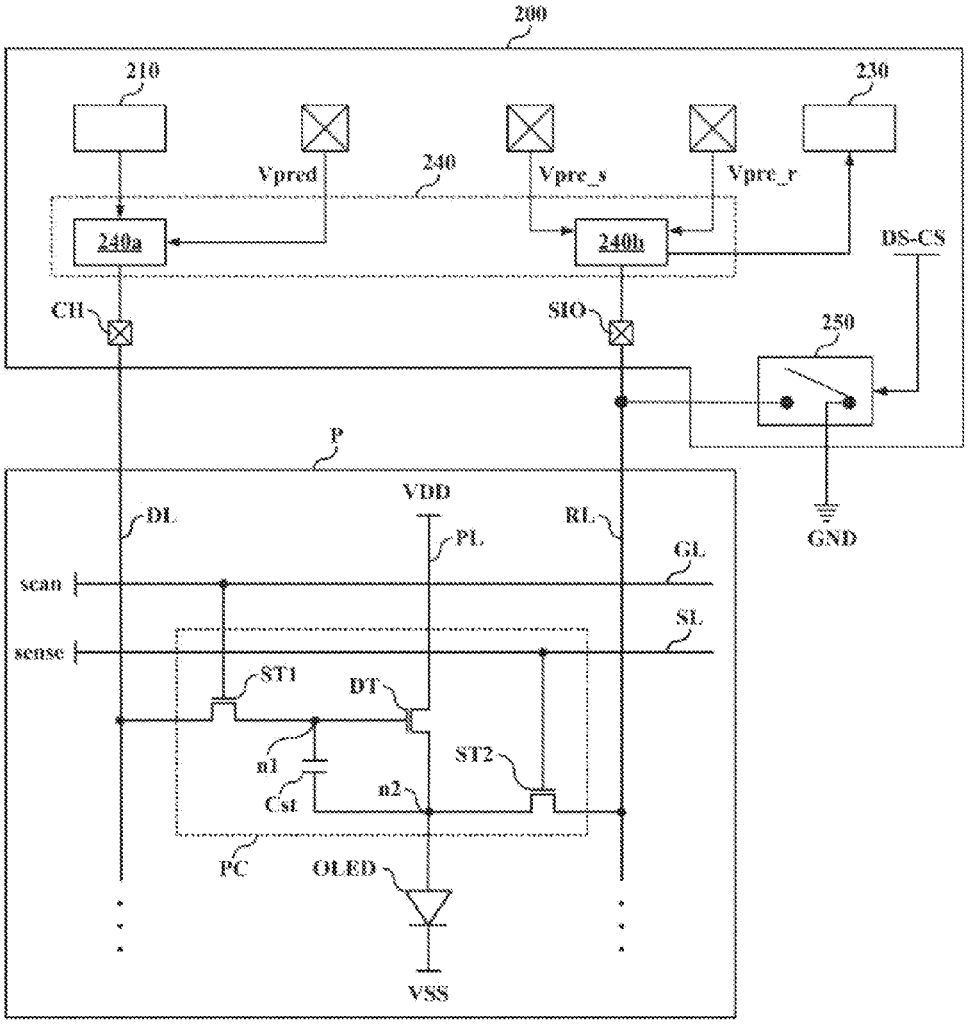
FIG. 5 is a circuit diagram illustrating a data driver and pixel structure of the organic light emitting display device according to an embodiment.

FIG. 4 is a diagram schematically illustrating an organic light emitting display device according to an embodiment. FIG. 5 is a circuit diagram for describing a data driver and pixel structure of the organic light emitting display device according to an embodiment.

With reference to FIGS. 4 and 5, the organic light emitting display device according to an embodiment includes a display panel 100 and a panel driving unit. The panel driving unit may include a data driver 200, a gate driver 300, a timing controller 400, and a memory 500 storing compensation data.

The display panel 100 may include a plurality of gate lines GL, a plurality of sensing signal lines SL, a plurality of data lines DL, a plurality of driving power lines PL, a plurality of reference power lines RL, and a plurality of pixels P.

Each of the plurality of pixels P may include an organic light emitting diode OLED and a pixel circuit PC for emitting light from the organic light emitting diode OLED.

A difference voltage between a data voltage Vdata and a reference voltage Vref (e.g., Vdata−Vref) may be charged into a capacitor Cst connected between a gate and source of the driving TFT DT. The driving TFT DT may be turned on with the voltage charged into the capacitor Cst. The organic light emitting diode OLED may emit light according to a data current I_oled that flows from a first driving voltage VDD terminal to a second driving voltage VSS terminal through the driving TFT DT. Each of the pixels P may include one of a red pixel, a green pixel, a blue pixel, and a white pixel. One unit pixel for displaying one image may include an adjacent red pixel, green pixel, and blue pixel, or may include an adjacent red pixel, green pixel, blue pixel, and white pixel.

Each of the plurality of pixels P may be formed in a pixel area defined in the display panel 100. To this end, the plurality of gate lines GL, the plurality of sensing signal lines SL, the plurality of data lines DL, the plurality of driving power lines PL, and the plurality of reference power lines RL may be formed in the display panel 100 to define the pixel area.

The plurality of gate lines GL and the plurality of sensing signal lines SL may be formed in parallel in a first direction (for example, a horizontal direction) in the display panel 100. A scan signal (gate driving signal) may be applied from the gate driver 300 to the gate lines GL. A sensing signal may be applied from the gate driver 300 to the sensing signal lines SL.

The plurality of data lines DL may be formed in a second direction (for example, a vertical direction) to intersect the plurality of gate lines GL and the plurality of sensing signal lines SL. Data voltages Vdata may be respectively supplied from the data driver 200 to the data lines DL. Each of the data voltages Vdata may have a voltage level to which a compensation voltage, corresponding to a shift of a threshold voltage (Vth) of a driving TFT DT of a corresponding pixel P, is added. The compensation voltage will be described in more detail below.

The plurality of reference power lines RL may be formed in parallel to the plurality of data lines DL. A display reference voltage Vpre_r or a sensing precharging voltage Vpre_s may be selectively supplied to the reference power lines RL by the data driver 200.

At this time, the display reference voltage Vpre_r may be supplied to each of the reference power lines RL during a data charging period of each pixel P. The sensing precharging voltage Vpre_s may be supplied to each reference power line RL during a detection period for which the threshold voltage/mobility of the driving TFT DT of each pixel P is detected. The plurality of driving power lines PL may be formed in parallel to the gate lines GL. The first driving voltage VDD may be supplied to each pixel P through a corresponding driving power line PL.

As illustrated in FIG. 5, the capacitor Cst of each pixel P may be charged with a difference voltage between the data voltage Vdata and the reference voltage Vref (e.g., Vdata−Vref) during a data charging period. Each pixel P may include a pixel circuit PC that supplies the data current I_oled to the organic light emitting diode OLED according to a voltage charged into the capacitor Cst during a light emitting period.

The pixel circuit PC of each pixel P may include a first switching TFT ST1, a second switching TFT ST2, the driving TFT DT, and the capacitor Cst. Here, the TFTs ST1, ST2, and DT may be N-type TFTs, and for example, may be an a-Si TFT, a poly-Si TFT, an oxide TFT, or an organic TFT. However, the present embodiments are not limited thereto, and the TFTs ST1, ST2, and DT may be formed as P-type TFTs.

The first switching TFT ST1 may have a gate connected to a corresponding gate line GL, a source (first electrode) connected to a data line DL, and a drain (second electrode) connected to a first node n1 connected to a gate of the driving TFT DT.

The first switching TFT ST1 may be turned on according to a gate-on voltage level of a scan signal supplied to the gate line GL. When the first switching TFT ST1 is turned on, a data voltage Vdata supplied to a corresponding data line DL may be supplied to the first node n1, for example, a gate of the driving TFT DT.

The second switching TFT ST2 may have a gate connected to a corresponding sensing signal line SL, a source (first electrode) connected to a corresponding reference power line RL, and a drain (second electrode) connected to a second node n2 connected to the driving TFT DT and the organic light emitting diode OLED.

The second switching TFT ST2 may be turned on according to a gate-on voltage level of the sensing signal supplied to the sensing signal line SL. When the second switching TFT ST2 is turned on, the display reference voltage Vpre_r or sensing precharging voltage Vpre_s supplied to the reference power line RL may be supplied to the second node n2.

The capacitor Cst may be connected between a gate and drain of the driving TFT DT, for example, between the first node n1 and the second node n2. The capacitor Cst may be charged with a difference voltage between voltages respectively supplied to the first and second nodes n1 and n2. The driving TFT DT may be turned on with a voltage charged into the capacitor Cst.

The gate of the driving TFT DT may be connected to the drain of the first switching TFT ST1 and a first electrode of the capacitor Cst in common. The drain of the driving TFT DT may be connected to a corresponding driving power line PL. A source of the driving TFT DT may be connected to the drain of the second switching TFT ST2, a second electrode of the capacitor Cst, and an anode of the organic light emitting diode OLED.

The driving TFT DT may be turned on with a voltage charged into the capacitor Cst at every light emitting period, and may control an amount of current flowing to the organic light emitting diode OLED according to the first driving voltage VDD.

The organic light emitting diode OLED may emit light in accordance with the data current I_oled supplied from the driving TFT DT of the pixel circuit PC, thereby emitting a single color light having a luminance corresponding to the data current I_oled.

To this end, the organic light emitting diode OLED may include an anode connected to the second node n2 of the pixel circuit PC, an organic layer (not shown) formed on the anode, and a cathode (not shown) that is formed on the organic layer and receives the second driving voltage VSS.

The organic layer may be formed to have a structure of hole transport layer/organic emission layer/electron transport layer or a structure of hole injection layer/hole transport layer/organic emission layer/electron transport layer/electron injection layer. Furthermore, the organic layer may further include a functional layer for enhancing a light efficiency and/or service life of the organic emission layer. In this case, the second driving voltage VSS may be supplied to the cathode of the organic light emitting diode OLED through a second driving power line (not shown) that is formed in a line shape.

The timing controller 400 may operate the data driver 200 and the gate driver 300 in a driving mode. The timing controller 400 may also operate the data driver 200 and the gate driver 300 in a sensing mode, according to a user's setting or at a predetermined time when a threshold voltage/mobility of a driving TFT is detected.

The sensing mode may be performed at an initial driving time of the display panel 100, at an end time after the display panel 100 is driven for a long time, or during a blank interval between frames where the display panel 100 displays an image. In the sensing mode, the timing controller 400 may generate a data control signal DCS and a gate control signal GCS for the threshold voltage/mobility of the driving TFT DT of each pixel P in units of one horizontal period, on the basis of a timing sync signal TSS.

The timing controller 400 may control the data driver 200 and the gate driver 300 in the sensing mode by using the data control signal DCS and the gate control signal GCS. The timing sync signal TSS may include a vertical sync signal Vsync, a horizontal sync signal Hsync, a data enable signal DE, and a clock DCLK. The gate control signal GCS may include a gate start signal and a plurality of clock signals. The data control signal DCS may include a data start signal, a data shift signal, and a data output signal.

The gate driver 300 may operate in the driving mode and the sensing mode according to mode control by the timing controller 400. The gate driver 300 may be connected to the plurality of gate lines GL and the plurality of sensing signal lines SL. In the driving mode, the gate driver 300 may generate a gate-on voltage level of a scan signal at every horizontal period according to the gate control signal GCS supplied from the timing controller 400. The gate driver 300 may sequentially supply the scan signal to the plurality of gate lines GL.

Here, the scan signal may have a gate-on voltage level during a data charging period of each pixel P. The scan signal may have a gate-off voltage level during a light emitting period of each pixel P. The gate driver 300 may be a shift register that sequentially outputs the scan signal.

The gate driver 300 may generate a gate-on voltage level of a sensing signal at every initialization period and sensing voltage charging period of each pixel P. The gate driver 300 may sequentially supply the sensing signal to the plurality of sensing signal lines SL.

The gate driver 300 may be configured in an integrated circuit (IC) type, or may be directly provided in a substrate of the display panel 100 in a process of forming the TFTs of the respective pixels P.

The gate driver 300 may be connected to the plurality of driving power lines PL1 to PLm. The gate driver 300 may supply a driving voltage VDD, supplied from an external power supply (not shown), to the plurality of driving power lines PL1 to PLm.

In the sensing mode at the initial driving time of the display panel 100 or at the end time after the display panel 100 is driven for a long time, the timing controller 400 may detect the threshold voltage/mobility of the driving TFT DT of each pixel P of the display panel 100 during one frame. In the sensing mode during the blank interval, the timing controller 400 may detect the threshold voltage/mobility of the driving TFT DTs of a plurality of pixels P formed on one horizontal line at every blank period. In such a scheme, the timing controller 400 may detect the threshold voltage/mobility of the driving TFT DT of each pixel P of the display panel 100 during a blank interval of a plurality of frames. In the sensing mode, the timing controller 400 may generate predetermined detection data, and supply the detection data to the data driver 200.

In the driving mode, the timing controller 400 may correct external input data Idata on the basis of detection data Dsen of the respective pixels P that are supplied from the data driver 200 in the sensing mode. Furthermore, the timing controller 400 may generate pixel data DATA based on the corrected input data, and supply the generated pixel data DATA to the data driver 200.

In this case, the pixel data DATA to be supplied to each pixel P may have a voltage level in which a compensation voltage for compensating for a change in characteristic (threshold voltage/mobility) of the driving TFT DT of each pixel P is reflected.

The input data Idata may include input red, green, and blue data to be supplied to one unit pixel. Furthermore, when the unit pixel is configured with a red pixel, a green pixel, and a blue pixel, one piece of pixel data DATA may be red data, green data, or blue data. On the other hand, when the unit pixel is configured with a red pixel, a green pixel, a blue pixel, and a white pixel, one piece of pixel data DATA may be red data, green data, blue data, or white data.

As illustrated in FIG. 5, the data driver 200 may be connected to the plurality of data lines D1 to Dn, and may operate in a display mode and the sensing mode according to mode control by the timing controller 400.

The driving mode for displaying an image may be driven in the data charging period, for which each pixel is charged with a data voltage, and the light emitting period for which each organic light emitting diode OLED emits light. The sensing mode may be driven in the initialization period for which each pixel is initialized, the sensing voltage charging period, and a sensing period.

The data driver 200 may include a data voltage generating unit 210, a switching unit 240, and a discharging driving unit 250.

The data voltage generating unit 210 may convert the input pixel data DATA into data voltages Vdata, and supply the data voltages Vdata to the respective data lines DL. To this end, the data voltage generating unit 210 may include a shift register, a latch, a grayscale voltage generator, a digital-to-analog converter (DAC), and an output unit.

The shift register may generate a plurality of sampling signals, and the latch may latch the pixel data DATA according to the sampling signals. The grayscale voltage generator may generate a plurality of grayscale voltages with a plurality of reference gamma voltages, and the DAC may select grayscale voltages corresponding to the latched pixel data DATA from among the plurality of grayscale voltages as data voltages Vdata to output the selected data voltages. The output unit may output the data voltages Vdata.

The switching unit 240 may include a plurality of first switches 240*a* and a plurality of second switches 240*b*. The plurality of first switches 240*a* may switch the data voltages Vdata or a reference voltage Vpre_d to the respective data lines DL in the driving mode.

The plurality of second switches 240*b* may switch the display reference voltage Vpre_r or the sensing precharging voltage Vpre_s so as to be supplied to the reference power lines RL in the sensing mode. Subsequently, the plurality of second switches 240*b* may float the reference power lines RL. Then, each of the plurality of second switches 240*b* may connect a corresponding reference power line RL to the sensing data generating unit 230, thereby allowing a corresponding pixel to be sensed.

The sensing data generating unit 230 may be connected to the reference power lines RL by the switching unit 240, and may sense a voltage charged into each of the reference power lines RL. The sensing data generating unit 230 may generate digital sensing data corresponding to the sensed analog voltage, and supply the digital sensing data to the timing controller 400.

In this case, the voltage sensed from the reference power line RL may be decided at a ratio of a current (flowing in a corresponding driving TFT DT) and a capacitance of the reference power line RL with time. Here, the sensing data may be data corresponding to a threshold voltage/mobility of the driving TFT DT of each pixel P.

In switching from the driving mode to the sensing mode, the discharging driving unit 250 may connect a corresponding reference power line RL to a ground GND according to a discharging control signal DS-CS inputted from the timing controller 400. Therefore, a voltage of the reference power line RL inputted in the driving mode is discharged. The discharging driving unit 250 may be configured with a switch that is turned on/off according to the discharging control signal DS-CS. Here, the discharging driving unit 250 may be configured as a logic circuit inside the data driver 200, or configured as a separate logic circuit outside the data driver 200.

Figure 6:
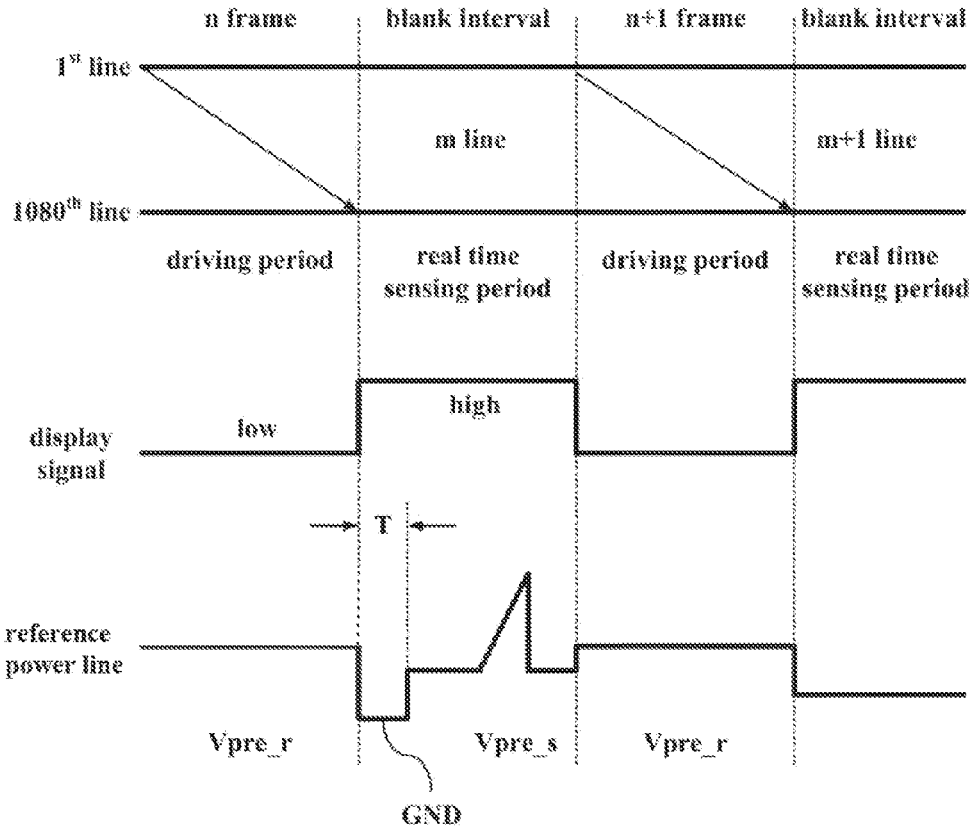
FIG. 6 is a diagram illustrating a display and sensing driving method of the organic light emitting display device according to an embodiment.

FIG. 6 is a diagram for describing a display and sensing driving method of the organic light emitting display device according to an embodiment. Hereinafter, an example configuration, display driving method, and sensing driving method of the data driver 200 will be described with reference to FIG. 6.

In the driving mode where an image is displayed, the data driver 200 may supply respective image data from the first data line to the last data line during a period of an Nth frame, thereby enabling an image to be displayed. At this time, the display reference voltage Vpre_r may be supplied to the sensing power lines RL.

When a display signal is changed from a low level to a high level, the discharging driving unit 250 may operate to connect the reference power line RL to the ground GND during a predetermined time T, according to the discharging control signal DS-CS applied from the timing controller 400. Therefore, a voltage of the reference power line RL inputted in the driving mode is discharged. Thus, an increased voltage in the reference power line RL is initialized to the ground GND by the driving operation.

Like this, when the reference power line RL is initialized to the ground GND at an initial stage of the sensing mode, the reference power line RL and an input terminal of the sensing data generating unit 230 of the data driver 200 may always be initialized to the same voltage at the initial stage of the sensing mode. Therefore, each pixel can be precisely sensed with the same sensing initial voltage. That is, each pixel can be sensed based on the same initial voltage regardless of a pattern of data voltages which are supplied to the respective pixels in the driving mode.

As illustrated in FIG. 6, a discharging operation by the discharging driving unit 250 may be performed in synchronization with a rising edge or falling edge of the display signal.

At this time, the discharging driving time T may be variably adjusted in order for the voltage of the reference power line RL to be completely discharged to the ground GND. For example, the discharging operation may be performed during a time which is previously set by a timer.

In the sensing mode, after the discharging operation is performed, the plurality of second switches 240*b* may be turned on during the blank interval between the nth frame and the n+1st frame, and may supply the sensing precharging voltage Vpre_s to one reference power line RL or a plurality of sensing power lines RL. For example, the sensing precharging voltage Vpre_s may be supplied at 1 V.

Subsequently, the second switch 240*b* may float a corresponding sensing power line RL, and then connect the reference power line RL to the sensing data generating unit 230, thereby allowing a corresponding pixel to be sensed.

The sensing data generating unit 230 may sense a voltage charged into the sensing power line RL. The sensing data generating unit 230 may generate digital sensing data corresponding to the sensed analog voltage, and supply the digital sensing data to the timing controller 400. At this time, a detected voltage may be converted into compensation data corresponding to the threshold voltage/mobility of the driving TFT DT of each pixel P.

In such a scheme, the display device may detect the threshold voltage/mobility of the driving TFT DT of each pixel of the display panel during a blank interval of a plurality of frames. The display device may generate compensation data on the basis of the detected threshold voltage/mobility. The display device may compensate for a data voltage Vdata applied to each pixel by using the compensation data.

As described above, in switching from the driving mode to the sensing mode, the reference power lines RL may be initialized by the discharging operation, thus preventing a sensing error from occurring in each pixel. Accordingly, accuracy of the sensing can increase, and thus a compensation performance of each pixel can be enhanced. Also, in switching from the driving mode to the sensing mode, a time taken in discharging can be shortened to, for example, 5 us to 6 us, and thus, compensation of each pixel can be accurately and quickly performed.

Moreover, the organic light emitting display device and the method of driving the same according to the present embodiments can sense each pixel independently from a pattern of an image displayed by the pixels in the driving mode. Accordingly, the present embodiments can prevent non-uniformity of image quality due to a sensing error, and enhance the display quality.

As described above, the organic light emitting display device and the method of driving the same according to the present embodiments can prevent a sensing error from occurring.

The organic light emitting display device and the method of driving the same according to the present embodiments can also prevent a defective quality of an image from occurring due to a sensing error.

The organic light emitting display device and the method of driving the same according to the present embodiments enable complete discharging to be performed quickly when switching from the driving mode to the sensing mode.

The organic light emitting display device and the method of driving the same according to the present embodiments can sense the pixels independently from a pattern of an image displayed by the pixels in the driving mode.

The organic light emitting display device and the method of driving the same according to the present embodiments can prevent non-uniformity of an image quality due to a sensing error when switching from the driving mode to the sensing mode.

The organic light emitting display device and the method of driving the same according to the present embodiments can save the time taken in discharging data voltages when switching from the driving mode to the sensing mode.

The organic light emitting display device and the method of driving the same according to the present embodiments can prevent the shortening of the display panel's service life.

The organic light emitting display device and the method of driving the same according to the present embodiments can enhance reliability of the display panel.

In addition to the aforementioned features and effects of the present embodiments, other features and effects can be construed from these embodiments.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device, comprising:

a display panel including a plurality of pixels having an organic light emitting diode and a pixel circuit configured to cause the organic light emitting diode to emit light;

a gate driver configured to supply the plurality of pixels with a scan signal used for driving the plurality of pixels and a sensing signal for sensing;

a data driver configured to supply respective data voltages and a reference voltage to the plurality of pixels in a driving mode, and sense respective voltages charged into the plurality of pixels in a sensing mode;

a discharging driving unit configured to initialize voltages of a plurality of reference power lines corresponding to the plurality of pixels after the display device switches from the driving mode to the sensing mode;

a timing controller configured to control the gate driver, the data driver, and the discharging driving unit to operate in and switch between the driving mode and the sensing mode; and a memory configured to store compensation data for the plurality of pixels, the respective data voltages supplied by the data driver to the plurality of pixels being compensated with the compensation data.

2. The organic light emitting display device of claim 1, wherein the discharging driving unit is driven according to a discharging control signal supplied from the timing controller to connect the plurality of reference power lines to a ground.

3. The organic light emitting display device of claim 2, wherein the discharging driving unit includes a switch that is turned on or off by the discharging control signal, wherein the switch is provided inside the data driver or provided as a separated element.

4. The organic light emitting display device of claim 1, wherein the discharging driving unit is configured to connect the plurality of reference power lines to a ground for a predetermined time.

5. The organic light emitting display device of claim 1, wherein the discharging driving unit is configured to initialize the voltages of the reference power lines corresponding to the plurality of pixels in synchronization with a rising edge or falling edge of a display signal.

6. The organic light emitting display device of claim 1, wherein the discharging driving unit initializes the voltages of the reference power lines corresponding to the plurality of pixels during a blank interval between an nth frame and an n+1st frame.

7. The organic light emitting display device of claim 1, further comprising:

a plurality of data lines configured to supply the respective data voltages to the plurality of pixels in the driving mode;

the plurality of reference power lines configured to supply the reference voltage to the plurality of pixels from the data driver in the driving mode, and in the sensing mode, configured to:

supply a sensing reference voltage to the plurality of pixels from the data driver; and supply the respective voltages charged into the plurality of pixels to the data driver;

a plurality of gate lines crossing the plurality of data lines, the plurality of gate lines configured to supply the scan signal from the gate driver to the plurality of pixels;

a plurality of sensing signal lines configured to supply the sensing signal for scanning from the gate driver to the plurality of pixels, wherein each pixel includes:

the pixel circuit including a first switching transistor, a second switching transistor, a driving transistor, and a capacitor; and the organic light emitting diode.

8. A method of driving an organic light emitting display device including a plurality of pixels that have an organic light emitting diode and a pixel circuit configured to cause the light emitting diode to emit light, the method comprising:

in a driving mode where an image is displayed, respectively supplying data voltages corresponding to image data from a first data line to a last data line during a period of one frame to thereby display an image;

in switching the driving mode to a sensing mode, initializing voltages of a plurality of reference power lines corresponding to the plurality of pixels;

after the voltages of the reference power lines are initialized, supplying a sensing precharging voltage to the reference power lines;

floating the reference power lines;

sensing the voltages of the reference power lines;

generating compensation data of each of the plurality of pixels on the basis of the sensed voltages; and compensating for the plurality of pixels on the basis of the compensation data.

9. The method of claim 8, wherein the initializing of voltages includes connecting the plurality of reference power lines to a ground for a predetermined time.

10. The method of claim 8, wherein the initializing of voltages includes initializing the voltages of the reference power lines corresponding to the plurality of pixels in synchronization with a rising edge or falling edge of a display signal.

11. The method of claim 8, wherein the initializing of voltages includes initializing the voltages of the reference power lines corresponding to the plurality of pixels during a blank interval between an nth frame and an n+1st frame.

12. The method of claim 8, wherein the initializing voltages of the plurality of reference power lines includes connecting the plurality of reference power lines to a ground.

13. The method of claim 8, wherein the compensation data corresponds to a threshold voltage and mobility of a driving thin film transistor of each of the plurality of pixels.

* * * * *